US006138886A

United States Patent [19]

Kjellberg et al.

[11] Patent Number: 6,138,886

[45] Date of Patent: Oct. 31, 2000

[54] DEVICE IN A WIRE ROLLING MILL

[75] Inventors: Hans Kjellberg, Savedalen; Anders Lindskog, Gothenburg, both of Sweden

[73] Assignee: Aktiebolaget SKF, Gothenburg, Sweden

[21] Appl. No.: 09/156,643

[22] Filed: Sep. 18, 1998

[30] Foreign Application Priority Data

Sep. 19, 1997 [SE] Sweden ..... 9703405

[51] Int. Cl.[7] ..... B65H 20/00

[52] U.S. Cl. ..... 226/188; 226/194; 226/177; 226/184; 72/249

[58] Field of Search ..... 226/188, 194, 226/177, 184; 72/249

[56] References Cited

U.S. PATENT DOCUMENTS

| | | | |
|---|---|---|---|
| 1,487,007 | 3/1924 | Biggert, Jr. | 72/249 |
| 1,840,171 | 1/1932 | Perrett | 72/249 |
| 1,953,165 | 4/1934 | George | 72/249 X |
| 3,677,056 | 7/1972 | Properzi | 72/227 |
| 3,824,830 | 7/1974 | Bennet et al. | 72/249 |
| 3,926,354 | 12/1975 | De Santis et al. | 226/188 X |
| 4,152,912 | 5/1979 | Shiozaki et al. | 72/249 X |
| 4,365,496 | 12/1982 | Shiozaki et al. | 72/249 |
| 4,785,653 | 11/1988 | Danielsson . | |
| 4,848,635 | 7/1989 | Lauener et al. | 226/188 X |
| 4,976,129 | 12/1990 | Setzer et al. | 72/249 X |
| 5,901,893 | 5/1999 | Furlani et al. | 226/188 X |

*Primary Examiner*—Donald P. Walsh
*Assistant Examiner*—Minh-Chan Pham
*Attorney, Agent, or Firm*—Burns, Doane, Swecker & Mathis, L.L.P.

[57] ABSTRACT

A device in a wire rolling mill includes a pair of grooved rolls. Each grooved roll is fixedly attached to the free end of a rotatably supported spindle. Each grooved roll is positionable relative to the other so that they between themselves define a rolling gap of adjustable size. At least one of the spindles is arranged integrally with the output shaft of an electro motor. The electro motor drives the spindle directly thereby avoiding heavy and space-requiring transmissions.

7 Claims, 1 Drawing Sheet

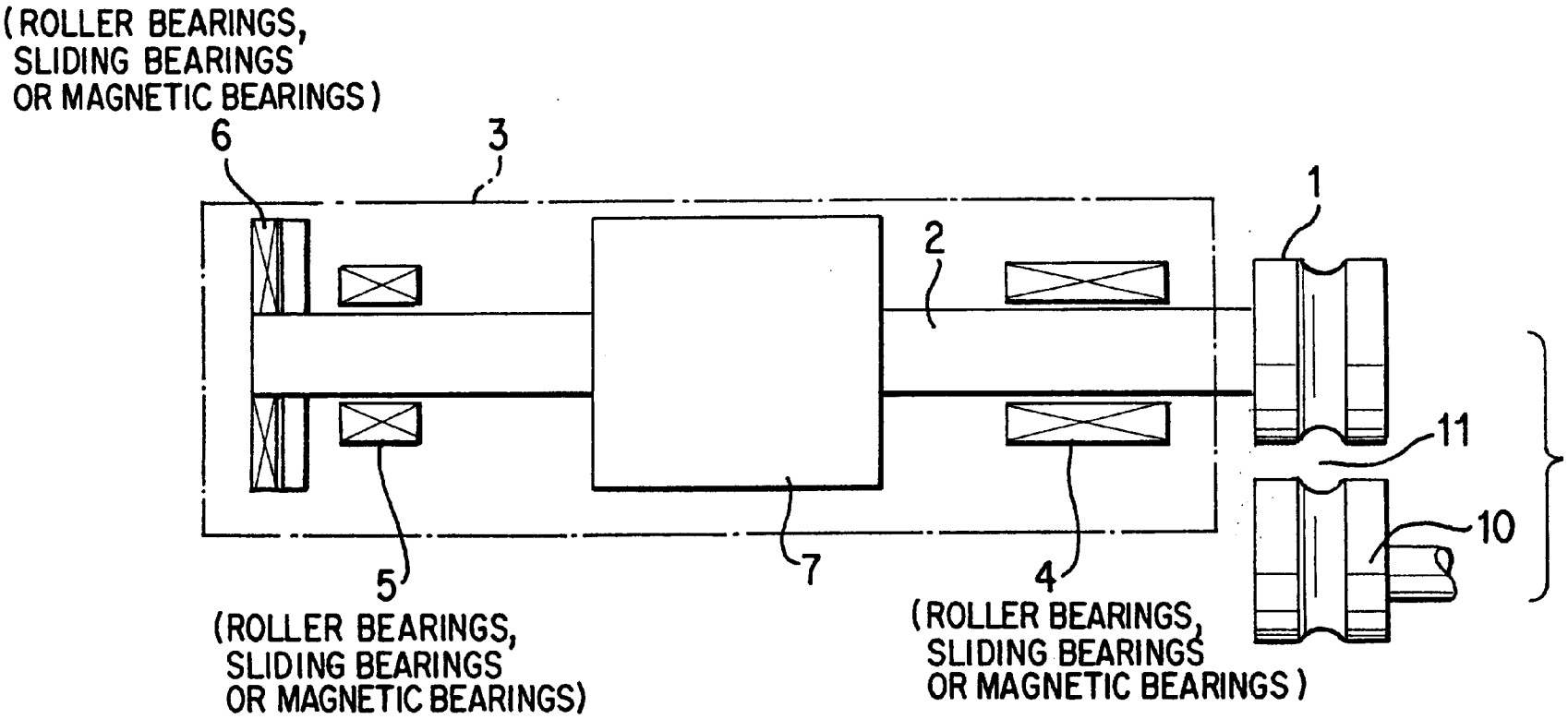
1
2
3
4
5
6
7
10
11
(ROLLER BEARINGS, SLIDING BEARINGS OR MAGNETIC BEARINGS)
(ROLLER BEARINGS, SLIDING BEARINGS OR MAGNETIC BEARINGS)
(ROLLER BEARINGS, SLIDING BEARINGS OR MAGNETIC BEARINGS)

DEVICE IN A WIRE ROLLING MILL

BACKGROUND

1. Field of the Invention

The present invention refers to wire rolling mills of the type comprising a pair of grooved rolls fixedly attached to the free end of one rotatably driven spindle each and being arranged to be positionable so relative to each other that they between themselves define a rolling gap of adjustable size.

2. Description of the Related Art

Wire rolling mills of this type commonly comprises a pair of parallel drive shafts which via transmissions, each incorporating e.g. a bevel gear and a pinion transfers the drive to one of the spindles. The pinion thereby is fixedly attached to one of the spindles at the end thereof opposite to the grooved roll and cooperating with the bevel gear for rotating the spindle. It is evident that such a design of the rolling mill with two drive shafts and transmissions needed for transferring the drive from the drive shafts to each of the spindles results in a voluminous and space-requiring assembly.

BRIEF SUMMARY OF THE DISCLOSURE

The purpose of the present invention is to provide a device in a wire rolling mill which obviates the drawbacks of the prior designs, thereby presenting a rolling mill spindle of much simplified design, which is still efficient and makes it possible to design the rolling mill in a very compact manner which minimizes the space requirement.

BRIEF DESCRIPTION OF THE DRAWINGS

The device according to the invention will be further described hereinafter with reference to the accompanying drawing, which shows schematically a rolling mill spindle in a side view.

DETAILED DESCRIPTION OF A PREFERRED EMBODIMENT

The grooved roll 1, which shall cooperate with another similar roll 10 (not shown), is firmly attached to the free end of a spindle 2, provided in a housing 3, which is shown in intimated form, and which in any appropriate manner, known per se, is movable (not shown) in such a manner that a rolling gap 11 between two cooperating grooved rolls 1 can be adjusted. In the embodiment shown the spindle 2 is supported in a first and a second radial bearing 4, 5 and in one axial bearing 6, although other bearing combinations can be used.

For the bearings 4, 5 and 6 can be used rolling bearings, sliding bearings or magnetic bearings or different combinations of such bearings.

An electro motor 7 is provided in the housing and the direct output shaft of this electro motor thereby is made integral with the spindle 2.

Each spindle forming part of the rolling mill is preferably provided with its integrated drive motor, for individual driving of the different rolls, although it is also possible to use a non-driven roll cooperating with the driven roll, in which case the non-driven roll spindle has no integrated motor.

The electro motor 7 used can be of any well known appropriate type available on the market.

With such a design the requirement for transmissions is eliminated and thereby the overall measures of the rolling mill can be considerably reduced.

What is claimed is:

1. A device in a wire rolling mill comprising a pair of grooved rolls each one being fixedly attached to a free end of a respective rotatably supported spindle, said pair of grooved rolls being positionable relative to each other to define between the grooved rolls a rolling gap of adjustable size, the spindle of at least one of said grooved rolls being arranged integrally with an output shaft of an electro motor to drive the spindle directly.

2. A device as claimed in claim 1, wherein the spindle of at least one of said pair of grooved rolls is supported in a combination of bearings supporting the spindle in radial and axial directions.

3. A device as claimed in claim 2, wherein the bearings are rolling bearings, sliding bearings, magnetic bearings or combinations thereof.

4. A device as claimed in claim 2, wherein the spindle of said at least one of said pair of grooved rolls, the electro motor and the bearings are enclosed in a bearing housing.

5. A device as claimed in claim 2, wherein the bearings support the spindle on opposite sides of the electro motor.

6. A device in a wire rolling mill comprising a pair of grooved rolls each one fixedly attached to a free end of a respective rotatably supported spindle, said pair of grooved rolls being positionable relative to each other to define between the grooved rolls a rolling gap of adjustable size, and a housing in which is positioned an electro motor having an output shaft, the spindle of at least one of said grooved rolls being integrally formed in one piece with the output shaft of the electro motor without any connection between the output shaft and the spindle of the at least one grooved roll to drive the spindle directly, said spindle of at least one of said grooved rolls being supported by a plurality of bearings located within the housing.

7. A device as claimed in claim 6, wherein the bearings are rolling bearings, sliding bearings, magnetic bearings or combinations thereof.

* * * * *